US006227991B1

(12) United States Patent
Carlton et al.

(10) Patent No.: US 6,227,991 B1
(45) Date of Patent: May 8, 2001

(54) SHUTTLECOCK

(76) Inventors: William Charles Carlton; Sarah Jane Gauchi Carlton, both of Villa Tas-Silg, Delimara Road, Marsaxlokk, ZTN 09 (MT)

( * ) Notice: Subject to any disclaimer, the term of this patent is extended or adjusted under 35 U.S.C. 154(b) by 0 days.

(21) Appl. No.: 09/180,207

(22) PCT Filed: Jan. 3, 1997

(86) PCT No.: PCT/GB97/00030

§ 371 Date: Nov. 4, 1998

§ 102(e) Date: Nov. 4, 1998

(87) PCT Pub. No.: WO97/43018

PCT Pub. Date: Nov. 20, 1997

(30) Foreign Application Priority Data

May 10, 1996 (GB) ..... 9609734

(51) Int. Cl.[7] ..... A63B 65/00
(52) U.S. Cl. ..... 473/580; 473/579
(58) Field of Search ..... 473/579, 580, 473/570, 578, 594, 603

(56) References Cited

U.S. PATENT DOCUMENTS

| | | | | |
|---|---|---|---|---|
| 227,884 | * | 5/1880 | Duchemin | 473/579 |
| 1,393,407 | * | 10/1921 | Tenney | 473/580 |
| 2,485,420 | * | 10/1949 | Timpe | 473/580 |
| 2,734,746 | * | 2/1956 | Sametz et al. | 473/579 |
| 3,749,402 | * | 7/1973 | Adickes et al. | 473/579 |
| 4,995,619 | * | 2/1991 | Hwang | 473/579 |
| 5,562,290 | * | 10/1996 | Wei | 473/579 |

FOREIGN PATENT DOCUMENTS

| | | | |
|---|---|---|---|
| 344938 | 4/1960 | (DE) . | |
| 2408604 | 9/1974 | (DE) . | |
| 9102324 | 6/1991 | (DE) . | |
| 907700 | 2/1961 | (GB) . | |
| 887172 | 1/1962 | (GB) . | |
| 908684 | 10/1962 | (GB) . | |
| 949110 | 2/1964 | (GB) . | |
| 1046708 | 10/1966 | (GB) . | |
| 90020902 * | 10/1993 | (WO) | 473/FOR 217 |

* cited by examiner

*Primary Examiner*—Mark S. Graham
(74) *Attorney, Agent, or Firm*—Clifford W. Browning; Woodard, Emhardt, Naughton, Moriarty & McNett

(57) ABSTRACT

A shuttlecock (1) comprising at least a cap (5, 10, 15) and a flared skirt (32, 25, 26), the flared skirt (32, 25, 26) incorporating an inflated device which may be a balloon (17, 22) or an expanded light moulded cone (13) with multiple connected cells made by a blowing agent. In one form the shuttlecock (1) is developed so that the said balloon (17) incorporates a plurality of extending fingers (18) arranged in a form which flares outwardly from the cap (15). In another form the shuttlecock comprises a cap (5, 10), an inner skirt (25) incorporating stems (6), an outer skirt (26) incorporating at least minor stems (7) and a balloon (22) adapted to support the stems (6, 7, 16, 35) and to fill in at least part of the spaces between the stems (6, 7, 16, 35) and to improve visibility. The balloon (17, 22) may be replaceable. The balloon inlet (21) incorporates a seal or a non-return valve and may pass through the cap (5, 10, 15) and/or the skirt connection.

18 Claims, 1 Drawing Sheet

SHUTTLECOCK

TECHNICAL FIELD

This invention relates to a shuttlecock which is a very light device used in the game of badminton. For the purposes of the specification all shuttlecocks have a cap, and a flared skirt; where necessary, the cap is divided into an outer cap and a skirt connector, similarly, the flared skirt is divided into an inner and an outer skirt.

BACKGROUND ART

There are two main types of shuttlecocks, those having a flared skirt made of feathers and those having a flared skirt made of plastic material. Feather shuttlecocks have a cap usually made of cork, the inner skirt being the stems or quills of the feathers and the outer skirt being made up of minor stems or the quill extensions which spread into the vanes. In the best feather shuttlecocks, the flared skirts are made of goose feathers which overlap in the outer skirt. Such shuttlecocks have the following desirable characteristics: the turnover is good; the whole shuttlecock is rigid; it rotates in flight and the outer skirt is very light; when struck severely, there is a resounding 'crack', a noise pleasing to the player; the inner skirt does not collapse and the shuttlecock decelerates rapidly. Such shuttlecocks have two main disadvantages, they are expensive and, if mis-hit, a stem may break and the flight becomes irregular so that the shuttlecock has to be discarded sometimes after only one or two minutes play.

In a plastic shuttlecock, the flared skirt has stems in the inner skirt (replacing quills in the feather); the stems become minor stems in the outer skirt and, to replace the vane in the feather, may be connected by a series of ribs in turn connected by a plurality of intermediate stems; the design varies. Cheaper models are made of a material such as polyethylene whilst the more expensive models are made of a material such as polyamide.

In models made according to the prior art, the deeper, stiffer and more numerous the stems, the more quickly the skirt recovers after collapsing when struck severely but the poorer the turnover. The turnover can be improved by reducing the number and/or cross-sectional area of stems, minor stems, ribs and intermediate stems. Spinning can be induced by inclining the stems and/or indenting parts of the outer skirt. The more the skirt is filled in by stems, minor stems, ribs and intermediate stems the better the 'crack' and visibility but the worse the turnover. Manufacture is a matter of comprise between stiffness, 'crack' visibility and turnover. Such shuttlecocks are known from GB-A-887172, GB-A-907700, GB-A-908684, GB-A-1046708 and, in particular, GB-A-949110. The shuttlecock known from GB-A-949110 has an upper skirt made of natural or artificial quills and a lower skirt made at least in part of a cellular plastic material. In one embodiment, the lower skirt is made from a solid as distinct from cellular material coated with a surface layer of cellular plastic material. In another embodiment, the lower skirt is made of a cellular plastic material.

Because of the rigidity of a new feather shuttlecock, when it is struck severely, the cap and feathers move together so that when the shuttlecock is in good condition collapsing is negligible but when a plastic shuttlecock, even a new one, is struck severely it can be shown by high speed photography that the skirt collapses until it is almost flat as shown in FIG. 1; the collapse is prolonged because the skirt is not strong enough to return to a substantially circular shape as it passes through the air with the result that when struck severely in a 'lob' the 'length', as dictated by the laws of badminton, may become unpredictable.

Technical Problem to be Overcome

The technical problem to be overcome in both the feather and the plastic shuttlecock is to provide a gradual support for the stems so that they are less likely to break when mis-hit and, in the plastic shuttlecock, 1) to support the stems to prevent the collapse of the skirt or make the recovery so quick as to make the collapse unimportant;
2) to fill in the spaces between the stems sufficiently to make the 'crack';
3) to improve visibility and turnover.

DISCLOSURE OF INVENTION

In accordance with the invention, these objects are accomplished in a shuttlecock having at least a cap, and a flared skirt, in that a balloon is incorporated in the space partially enclosed by the flared skirt.

In a shuttlecock wherein said cap comprises an outer cap and a skirt connector and wherein the said flared skirt comprises at least an inner skirt incorporating stems, and an outer skirt incorporating at least minor stems, the invention may be further developed in that the said balloon is incorporated in the space partially enclosed by the said inner skirt, the balloon thus being adapted to support at least the said stems and fill in at least part of the spaces adjacent the stems thus improving visibility.

The said balloon may incorporate a plurality of extending fingers integral with the main body of the balloon arranged in a form which flares outwardly from the cap.

Preferably, the said balloon has a balloon inlet and is adapted to be inflated through a hole in the cap.

The invention may be developed further in that the balloon inlet retainer is enclosed within the said cap and the said balloon is adapted to be inflated through an orifice in the said balloon inlet retainer.

The said balloon inlet retainer may be split before assembly and held together after assembly.

Preferably, the balloon inlet passes through the said orifice in which the said inlet is compressed and held against rotation relative to the cap when the balloon, after inflation, is slightly rotated relative to the said skirt.

A small bore tube may be inserted in the balloon inlet and a structure equivalent to at least one 'O' ring compresses the said balloon inlet around the said small bore tube, the arrangement being such that a non-return valve is made when the small bore tube is withdrawn.

Advantageous Effects

The balloon supports the shape of the inner skirt both remote from and adjacent to the racket. When the shuttlecock is struck severely, collapse is largely prevented and, because of the air pressure within the balloon any collapse is restored almost instantaneously to a substantially circular shape. The stems in the inner skirt in both feather and plastic shuttlecocks are given a flexible gradual support so that breakage of the stems is reduced. The stems may be reduced in number and, in plastic shuttlecocks, their crosssectional area may be shaped to facilitate the flow of material during injection thereby improving turnover and, because the spaces adjacent to the stems are filled by the balloon the visibility is improved and the shuttlecock makes a 'crack ' when struck severely. The orifice may be split so that the balloon inlet is easily assembled.

MODES OF CARRYING OUT THE INVENTION

The invention will now be described by way of example and with reference to the accompanying diagrammatic drawings in which.

Figure 1:
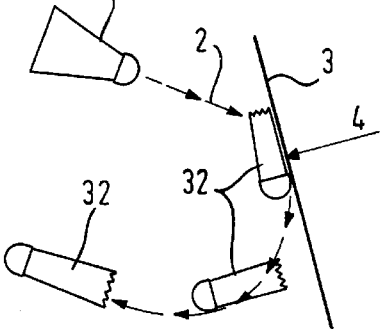
FIG. 1 is a view of a shuttlecock with a plastic skirt approaching, striking and leaving a racket face.

Referring to FIG. 1, a plastic shuttlecock 1, having a skirt 37 and moving in the direction of the arrows 2 is struck by a racket face 3 moving in the direction of the arrow 4. Both sides of the skirt 37 flatten head remain flattened as the flight continues but will slowly recover unless intercepted in flight.

Figure 2:
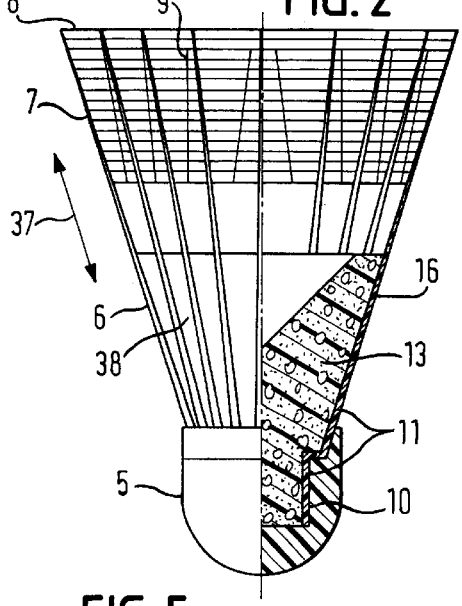
FIG. 2 is a view of a plastic shuttlecock partly in half section.
Figure 3:
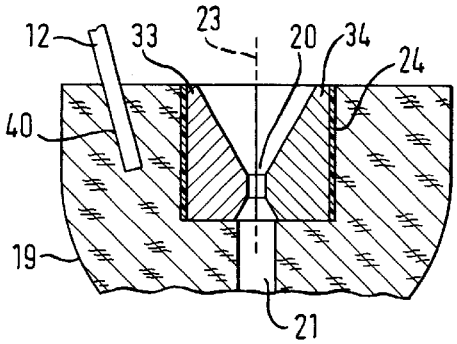
FIG. 3 is an enlarged view of a cork cap incorporating a form of the invention.

On the left of FIG. 2 is a cap 5, an inner skirt 16 incorporating stems 6 which continue into an outer skirt and become minor stems 7. The said minor stems 7 spread into angled ribs 8 and intermediate stems 9. As an alternative, the flared skirt 37 may be made up of feathers, the quills are then the stems and the extensions of the quills then become the minor stems which spread into the vane. On the right of FIG. 2 the shuttlecock is shown in half section; the inside of an outer cap portion made of moulded material which could be replaced by a cork cap 19 as shown in FIG. 3, surrounds a skirt connector 11. A light molded cone 13 which has been expanded by a blowing agent is forced into the skirt connector 11 and into the lower skirt where it supports the stems 6.

Figure 6:
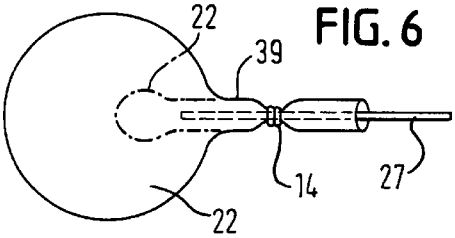
FIG. 6 is a view of a balloon incorporating a non-return valve.

Referring to FIGS. 3 and 6, a balloon inlet retainer split into two parts 33, 34, is forced into a plastic sleeve 24; the two parts 33, 34 are shaped so that an orifice 20 is left into which a balloon inlet 39 will nest with an 'O' ring 14, if required. In the case of a plastic shuttlecock, the sleeve 24 could be a skirt connector; in the case of a feather shuttlecock the quills 12 (one quill shown) go directly into the cork cap 19 and the balloon inlet retainer 33, 34 may be integral with the cork cap 19.

The size of the orifice 20 is such that the force created by the inflated balloon is unable to pull the outer part of the balloon inlet 39 through the orifice 20. A hole 21 through which inflation may take place is made in the bottom of the cap 19; a rod may be pushed through the hole 21 to eject the balloon inlet retainer 33, 34 if it is necessary to replace the balloon. If the inlet retainer 33, 34 is made of cork it may be desirable to coat the surface of the orifice 20 with, for instance, epoxy, to strengthen it. The balloon inlet retainer 33, 34 may be replaced by an equivalent design in another material. If very thin balloon material is used the balloon inlet retainer may be in one piece.

Figure 4:
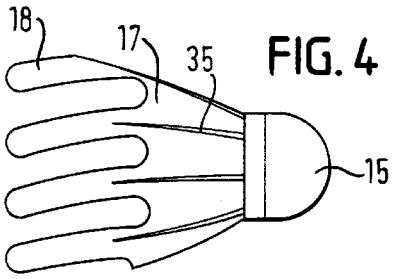
FIG. 4 is a view of a shuttlecock incorporating flared fingers which form at least part of an outer skirt.

Referring now to FIG. 4 the shuttlecock comprises a cap 15 and moulded stems 35 forming the inner skirt which partially encloses a balloon 17 which has, integral with its main body, a plurality of inflated fingers 18 flared outwards from the cap and which form the outer skirt. The fingers 18 may be shaped to cause rotation.

Figure 5:
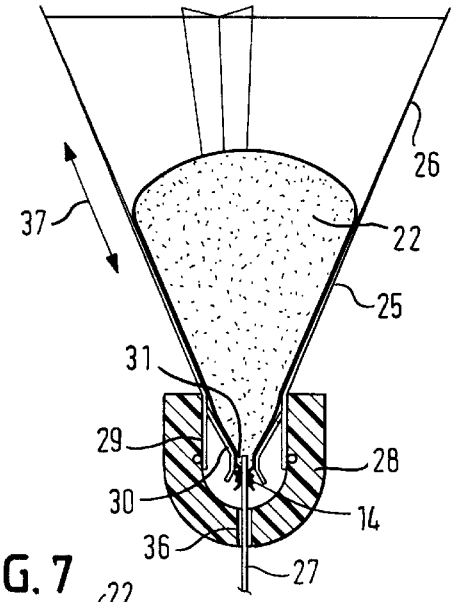
FIG. 5 is a view in section of a shuttlecock incorporating a balloon.
Figure 7:
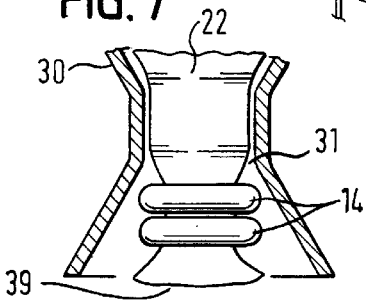
FIG. 7 is an enlarged detail of FIG. 6.

Referring to FIGS. 5, 6, 7, an outer cap 28 surrounds a plastic skirt connector 29 which, in this case, is integral with the inner skirt 25 and the outer skirt 26 of a plastic shuttlecock. Also shown is part of an inflated balloon 22 and integral with the skirt connector 29 is a conical part 30 with an orifice 31 which is just too small for the 'O' rings 14 to pass through but large enough for the closed end of a deflated balloon 21 (FIG. 6) to be pulled through it. One end of a very small bore plastic tube 27 is inserted in the inlet end 39 of the deflated balloon 21 and pulled with the closed end of the deflated balloon through at least one 'O' ring 14 and the orifice 31. The free end of the small bore tube 27 is left protruding and is fed through the hole 36 in the end of the cap 28. The orifice 31 may be split as explained with reference to FIG. 3.

When inflation is required, a pump is fitted to the free end of the small bore tube 27 and the balloon is inflated. The small bore tube 27 is then withdrawn quickly, the 'O' ring(s) 14 close(s) the inlet 39 and the balloon 22 remains inflated. A sealing lubricant may be used to assist withdrawal. Preferably also, whilst the inlet end 39 of the balloon 22 is held relative to the cap and/or skirt connector, after inflation the balloon is slightly rotated relative to the inner skirt 25.

What is claimed is:

1. A shuttlecock comprising a cap and a flared skirt, characterised in that a balloon is incorporated in a space partially enclosed by the flared skirt.

2. The shuttlecock as in claim 1 in which said cap comprises an outer cap and a skirt connector and said flared skirt comprises at least an inner skirt incorporating stems, and an outer skirt incorporating at least minor stems, characterised in that the said balloon is incorporated in the space partially enclosed by the said inner skirt, the balloon thus being adapted to support at least the said stems and fill in at least part of the spaces adjacent the stems.

3. The shuttlecock as in claim 1, characterized in that the balloon comprises a plurality of inflated fingers flared outwards from the cap.

4. The shuttlecock as in claim 1, characterised in that the said balloon has a balloon inlet and is adapted to be inflated through a hole in the cap.

5. The shuttlecock as in claim 2, characterised in that the balloon comprises a plurality of inflated fingers flared outwards from the cap.

6. The shuttlecock as in claim 5, characterised in that the said balloon has a balloon inlet and is adapted to be inflated through a hole in the cap.

7. The shuttlecock as in claim 6, characterised in that a balloon inlet retainer is enclosed within the said cap and the said balloon is adapted to be inflated through an orifice in the said balloon inlet retainer.

8. The shuttlecock as in claim 4, characterised in that the balloon inlet passes through the said orifice in which the said inlet is compressed when the balloon, after inflation, is slightly rotated relative to the said skirt.

9. The shuttlecock as in claim 4, characterised in that a small bore tube is inserted in the balloon inlet and a structure equivalent to at least one 'O' ring compresses the said balloon inlet around the said small bore tube, whereby a non-return valve is made when the said small bore tube is withdrawn.

10. A shuttlecock comprising, a cap and a flared skirt, characterized in that a balloon is incorporated in a space partially enclosed by the flared skirt, and said balloon has a balloon inlet and is adapted to be inflated through a hole in the cap, and a balloon inlet retainer is enclosed within the said cap and said balloon is adapted to be inflated through an orifice in the said balloon inlet retainer.

11. The shuttlecock as in claim 10, characterised in that the said balloon inlet retainer is split before assembly and held together after assembly.

12. A shuttlecock comprising a cap and a flared skirt, characterised in that a balloon is incorporated in the space partially enclosed by the flared skirt, in which said cap comprises an outer cap and a skirt connector, and said flared skirt comprises at least an inner skirt incorporating stems, and an outer skirt incorporating at least minor stems, characterised in that the said balloon is incorporated in the space partially enclosed by the said inner skirt, the balloon thus being adapted to support at least the said stems and fill in at least part of the spaces adjacent the stems, and said balloon has a balloon inlet and is adapted to be inflated through a hole in the cap.

13. The shuttlecock as in claim 12, characterised in that a balloon inlet retainer is enclosed within the said cap and the said balloon is adapted to be inflated through an orifice in the said balloon inlet retainer.

14. The shuttlecock as in claim 13, characterised in that the balloon inlet passes through the said orifice in which the said inlet is compressed when the balloon, after inflation, is slightly rotated relative to the said skirt.

15. A shuttlecock comprising a cap and a flared skirt, characterised in that a balloon is incorporated in the space partially enclosed by the flared skirt, and the balloon comprises a plurality of inflated fingers flared outwards from the cap and said balloon has a balloon inlet and is adapted to be inflated through a hole in the cap.

16. The shuttlecock as in claim 15, characterised in that a balloon inlet retainer is enclosed within the said cap and the said balloon is adapted to be inflated through an orifice in the said balloon inlet retainer.

17. The shuttlecock as in claim 16, characterised in that the balloon inlet passes through the said orifice in which the said inlet is compressed when the balloon, after inflation, is slightly rotated relative to the said skirt.

18. A shuttlecock comprising a cap and a flared skirt, characterized in that a balloon is incorporated in the space partially enclosed by the flared skirt, in which said cap comprises an outer cap and a skirt connector and said flared skirt comprises at least an inner skirt incorporated stems, and an outer skirt incorporating at least minor stems, characterised in that the said balloon is incorporated in the space partially enclosed by the said inner skirt, the balloon thus being adapted to support at least the said stems and fill in at least part of the spaces adjacent the stems, and the balloon comprises a plurality of inflated fingers flared outwards from the cap, and said balloon has a balloon inlet and is adapted to be inflated through a hole in the cap and the balloon inlet passes through a orifice in which the said inlet is compressed when the balloon, after inflation, is slightly rotated relative to the said skirt.

* * * * *

UNITED STATES PATENT AND TRADEMARK OFFICE

CERTIFICATE OF CORRECTION

PATENT NO. : 6,227,991 B1 
DATED : May 8, 2001
INVENTOR(S) : William Charles Carlton and Sara Jane Gauchi Carlton It is certified that error appears in the above-identified patent and that said Letters Patent is hereby corrected as shown below:

Title page,
Under FOREIGN PATENT DOCUMENTS, please change "90020902 * 10/1993 (WO)" to -- 93020902 * 10/1993 (WO) --.

Column 5,
Line 20, please change "as in claim 13," to -- as in claim 12, --.

Column 6,
Line 7, please change "as in claim 16," to -- as in claim 15, --.
Line 24, please change "a orifice" to -- the said orifice --.

Signed and Sealed this

Ninth Day of July, 2002

*Attest:*

*Attesting Officer*

JAMES E. ROGAN
*Director of the United States Patent and Trademark Office*